US008581512B2

(12) United States Patent
Hamamoto et al.

(10) Patent No.: US 8,581,512 B2
(45) Date of Patent: Nov. 12, 2013

(54) LIGHT SOURCE MODULE, LIGHTING APPARATUS, AND ILLUMINATION DEVICE USING THE SAME

(75) Inventors: Katunobu Hamamoto, Neyagawa (JP); Koji Fujimoto, Katano (JP)

(73) Assignee: Panasonic Corporation, Osaka (JP)

( * ) Notice: Subject to any disclaimer, the term of this patent is extended or adjusted under 35 U.S.C. 154(b) by 183 days.

(21) Appl. No.: 13/094,053

(22) Filed: Apr. 26, 2011

(65) Prior Publication Data

US 2011/0260648 A1 Oct. 27, 2011

(30) Foreign Application Priority Data

Apr. 26, 2010 (JP) ..... 2010-101149

(51) Int. Cl.
*H05B 37/02* (2006.01)

(52) U.S. Cl.
USPC ..... 315/291; 315/307

(58) Field of Classification Search
USPC ..... 315/291, 294, 307–309
See application file for complete search history.

(56) References Cited

U.S. PATENT DOCUMENTS

2011/0121740 A1* 5/2011 Shih ..... 315/185 R
2012/0043892 A1* 2/2012 Visser et al. ..... 315/121
2012/0235575 A1* 9/2012 Roberts et al. ..... 315/151
2012/0299507 A1* 11/2012 Chen et al. ..... 315/291
2013/0038230 A1* 2/2013 Brown et al. ..... 315/201

FOREIGN PATENT DOCUMENTS

| | | |
|---|---|---|
| CN | 201001216 | 1/2008 |
| DE | 10 2008 033 176 | 1/2010 |
| EP | 1 411 750 | 4/2004 |
| JP | 2009-21175 | 1/2009 |
| JP | 2009-224046 | 10/2009 |
| WO | 2009/136322 | 11/2009 |

OTHER PUBLICATIONS

The extended European search report dated Aug. 17, 2011.
Office Action dated Jul. 10, 2013 issued in the corresponding Chinese application No. 201110108247.1.

* cited by examiner

*Primary Examiner* — Don Le
(74) *Attorney, Agent, or Firm* — Bacon & Thomas, PLLC

(57) ABSTRACT

A light source module includes: a light source unit including a plurality of light-emitting diodes (LEDs) electrically connected to each other; a characteristic setting unit for setting characteristic information on electrical characteristics of the LEDs; a first pin base having a first electrode and a second electrode; and a second pin base having a third electrode and a fourth electrode, wherein a direct current (DC) voltage supplied from a lighting apparatus is applied between the first electrode and the second electrode or between the third electrode and the fourth electrode, a constant voltage is supplied to an anode side of the LEDs of the light source unit, and the characteristic setting unit is connected between the first and second electrodes and/or between the third and fourth electrodes.

10 Claims, 12 Drawing Sheets

LIGHT SOURCE MODULE, LIGHTING APPARATUS, AND ILLUMINATION DEVICE USING THE SAME

FIELD OF THE INVENTION

The present invention relates to a light source module that uses light-emitting diodes (LEDs) as a light source, a lighting apparatus for lighting up the light source module, and an illumination device using the same.

BACKGROUND OF THE INVENTION

So far, fluorescent lamps have been the main light sources used for illumination, and illumination devices which perform high frequency lighting using inverter lighting apparatuses have become widely popularized. Recently, LEDs have been attracting attention as being electrical light sources other than a discharge lamp which is represented as the fluorescent lamp. LEDs are superior to fluorescent lamps particularly in terms of life span, and it is expected that the efficiency thereof will exceed that of FHF32, that is, the main stream of fluorescent lamps for base illumination, thanks to future improvements in the technology.

Meanwhile, in a light source module in which a plurality of LEDs are mounted due to the development of the technology of LEDs, it is necessary to determine the number of LEDs used so that the light emitted from the light source module becomes almost constant and to determine whether to connect the LEDs in series or in parallel to each other. That is, it is required to appropriately determine a current value and a voltage value of the light source module by determining the number of LEDs used and the type of connection made between the LEDs.

Furthermore, also in a lighting apparatus for supplying current to the light source module, it is required to make a proper output in order to save power in accordance with the progress of the technology of LEDs. However, the current value and voltage value of the light source module vary depending on the electric characteristics of each LED, the number of LEDs used and series or parallel connection, which was described above. Accordingly, for example, there occurs the restriction in which the light source module should be configured to make the current value of the light source module constant (depending on the characteristics of LEDs, the number of LEDs used, and the type of connection between the LEDs) regardless of the advancements made in the technology of LEDs.

For example, it is assumed that there is a lighting apparatus having a light source module (hereinafter referred to as "LED module") in which five LEDs have been connected in series. Herein, the voltage characteristic of each LED is 3.5 V, and the applied voltage of the LED module is then 3.5×5=17.5 V. When an LED module in which four LEDs having the same characteristic have been connected in series is connected to the lighting apparatus, excessive voltage is applied, so that excessive current flows.

Patent document 1 (Japanese Patent Application Publication No. 2009-224046) discloses a method for preventing failures attributable to the excessive current, in which a notification terminal for providing notification of an LED module being connected and disconnected is provided and the excessive current is prevented in response to a notification signal from the notification terminal. Furthermore, the configuration that maintains current outputted to the LED module at a constant level is provided.

Patent document 2 (Japanese Patent Application Publication No. 2009-21175) discloses a constant current circuit which has information about the electric characteristics of each LED module in which a plurality of LEDs have been mounted and provides constant current to each LED module. The information of each LED module is transferred to a lighting apparatus capable of supplying power to a plurality of LED modules, so that control is performed such that the output appropriate for the number of connected LED module is performed.

The example of the patent document 1 takes into account only the difference in the number of LEDs used, and does not consider the above-described advancements made in the technology of LEDs. For example, when the voltage characteristic of each LED is 3.5 V, the current characteristic thereof is 0.3 A and ten LEDs are connected in series, the applied voltage of an LED module is 3.5×10=35 V and the output current is 0.3 A. If, for example, the voltage characteristic of each LED is 3.0 V and the current characteristic thereof is 0.2 A thanks to the advancements in the technology of LEDs, the applied voltage of an LED module in which eight LEDS have been connected in series becomes 3.0×8=24 V. When seven LEDs each having a voltage characteristic of 3.5 V are connected in series, 3.5×7=24.5 V. The difference in voltage resulting from the difference in voltage characteristic and the difference in the number of LED used is not substantially large. However, by applying a current of 0.3 A to a LED having an output current of 0.2 A, the problem of abnormal generation of heat, a failure or a short life span attributable to excessive current is caused.

Furthermore, as a light source using LEDs, there have been proposed various types of light source modules which have the same pin base structure and the same lamp shape as linear fluorescent lamps and which can be installed on general illumination devices for fluorescent lamps. The two pin bases of a light source, such as a linear fluorescent lamp, will be referred to as a first pin base and a second pin base, respectively. While a fluorescent lamp is not lit up, the impedance of the first and second pin bases is almost infinite, so that a user replaces the fluorescent lamp in a state that the illumination device is being supplied with current. In this case, there occurs no risk although the user erroneously touches an electrode of the second pin base while inserting the electrodes of the first pin base into a socket of the illumination device. However, for a light source using LEDs, when, for example, the anode side is connected to the first pin base and the cathode side is connected to the second pin base, there is a worry over an electric shock if the electrodes of the first pin base are inserted into a socket and then user's contact with an electrode of the second pin base occurs upon the above-described replacement of the lamp.

Although the above-described patent document 1 does not describe a detailed technology for the structure of the LED module or an electrical connection structure of the LED modules, the patent document 1 adopts an output terminal mechanism in which conduction terminals to the LEDs and the notification terminals have been integrated. Accordingly, if a special and new connection structure is developed in order to prevent an electric shock from being occurring upon the replacement of the LED module, the worry over the electric shock can be avoided. However, it is necessary to invest in the development of the above-described LED module, the output terminal mechanism and a new illumination device in which the LED module and the output terminal mechanism can be installed.

In the patent document 2, the information that each LED module has is processed using a microcomputer. For example, a data table in which a plurality of pieces of information about the electric characteristics of LEDs, the numbers of LEDs, and connection type regarding series or parallel connection have been previously set to reflect the advancements in the LED technology may be provided, corresponding data may be selected in accordance with the characteristics and number of LEDs used, and the lighting apparatus may receive the data and output an appropriate current value.

If this technology is utilized, a lighting apparatus capable of dealing with future advancements in the technology of LEDs can be implemented, so that it is not necessary to maintain a constant total current of an LED module or to limit the characteristics, numbers and connection types of LEDs.

However, since it is necessary to install a data retention unit (a microcomputer or the like) and a control power source circuit for the data retention unit in each LED module, the configuration of the LED module is complicated, the cost of the LED module is increased, and the control power source circuit for the data retention unit installed in each LED module is difficult to configure.

To read information of each LED module before the LED module is lit up, a method of always outputting a voltage at a level at which the LED module cannot be lit up by means of the lighting apparatus and generating control power using the output voltage or a method of generating control power in the lighting apparatus and supplying the power to the LED module using another wire may be taken into consideration. The former method generates power loss because the lighting apparatus needs to be operated while the LED module is not being connected. The latter method causes the wiring between the lighting apparatus and the LED module to be complicated.

Furthermore, when the LED module is connected to the lighting apparatus, a connection structure or a socket structure is required so that a current supply line to the LEDs and a signal line from the data retention unit can be connected to each other without causing an error. In addition, when the LED module is replaced, it is desirable to provide a configuration which enables a user or a worker to relatively easily replace the LED module. Since the conventional technology does not provide a specific technology for configuring an electrical connection nor a specific technology for the structure of the LED module, there is a worry over the electric shock when the LED module is replaced. In order to provide countermeasures for the above worry, it is necessary to invest in new development, like in the case of the patent document 1.

SUMMARY OF THE INVENTION

In view of the above, the present invention provides a light source module and a lighting apparatus that can deal with the advancements in the technology of LEDs and that can be safely installed in a general illumination device for a fluorescent lamp, and an illumination device using the same.

In accordance with a first aspect of the present invention, there is provided a light source module, including: a light source unit including a plurality of light-emitting diodes (LEDs) electrically connected to each other; a characteristic setting unit for setting characteristic information on electrical characteristics of the LEDs; a first pin base having a first electrode and a second electrode; and a second pin base having a third electrode and a fourth electrode, wherein a direct current (DC) voltage supplied from a lighting apparatus is applied between the first electrode and the second electrode or between the third electrode and the fourth electrode, a constant voltage is supplied to an anode side of the LEDs of the light source unit, and the characteristic setting unit is connected between the first and second electrodes and/or between the third and fourth electrodes.

In accordance with a second aspect of the present invention, there is provided a lighting apparatus, including: the light source module; a voltage conversion unit, which includes at least one switching device, for receiving, as a power, an external DC voltage or a rectified voltage obtained by rectifying an input alternating current (AC) voltage, and for converting the received voltage into a desired voltage by turning on and off the corresponding switching device thereby to supply the desired voltage to the first or the second pin base of the light source module; a setting power source for supplying a power to the characteristic setting unit via the first or the second pin base; and a characteristic determination unit for determining the characteristic information, wherein the first and the second pin bases have a structure attachable to an illumination device for a fluorescent lamp, and the characteristic determination unit determines the characteristic information based on a signal generated at a pin base other than a pin base to which the voltage conversion unit is connected.

In accordance with a third aspect of the present invention, there is provided an illumination device, including the light source module and the lighting apparatus.

In accordance with the present invention, characteristic information corresponding to the electrical characteristics of each LED can be previously set in the characteristic setting unit and, therefore, the advancements made in the technology of LEDs can be handled. In accordance with another aspect of the present invention, a lighting apparatus which is capable of stably lighting up the light source module can be implemented. In accordance with another aspect of the present invention, the light source module can be safely installed in a general illumination device for a fluorescent lamp.

DETAILED DESCRIPTION OF THE EMBODIMENTS

Embodiment 1

Figure 1:
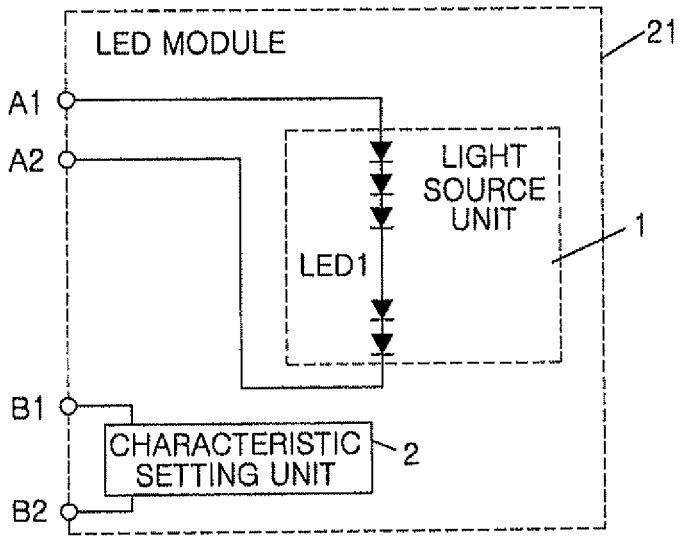
FIG. 1 is a circuit diagram of an LED module in accordance with a first embodiment of the present invention.

FIG. 1 is a diagram showing a circuit configuration of an LED module in accordance with a first embodiment of the present invention. As shown in FIG. 1, an LED module 21 includes a light source unit 1 configured such that a plurality of light-emitting diodes (LEDs) are connected in series to each other and a characteristic setting unit 2 for setting characteristic information of the LEDs LED1, for example, information corresponding to a target current value.

The anode side of the light source unit 1 is connected to a connection terminal A1 which is selectively and electrically connected and disconnected to a lighting apparatus provided outside the LED module 21, and the cathode side of the light source unit 1 is connected to a connection terminal A2. The characteristic setting unit 2 is connected between connection terminals B1 and B2.

Figure 2:
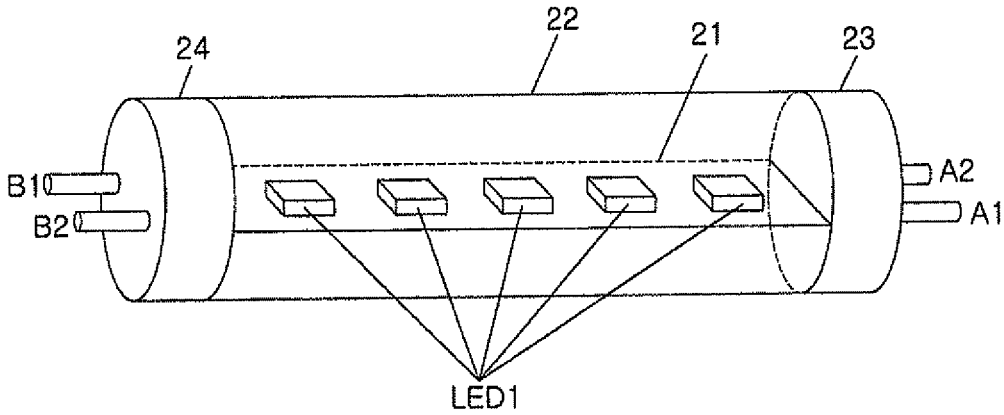
FIG. 2 is a perspective view showing a schematic configuration of the LED module in accordance with the first embodiment of the present invention.

FIG. 2 shows an example of a structure of the LED module 21. As shown in this drawing, one or more rectangular substrate on which the plurality of LEDs LED1 constituting the light source unit 1 are mounted is/are contained in a transparent housing 22, a pin base 23 including the connection terminals A1 and A2 is provided at one end of the housing 22, and a pin base 24 including the connection terminals B1 and B2 is provided at the other end thereof.

Figure 9:
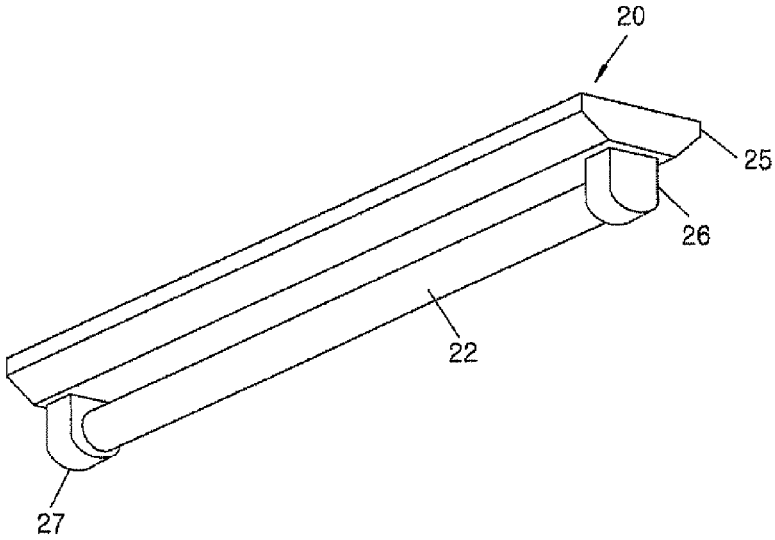
FIG. 9 is a perspective view of an illumination device in which the LED module has been installed in accordance with the first embodiment of the present invention.

The shape of the housing 22 of the LED module 21 and the distance between the connection terminals A1 and A2 and the connection terminals B1 and B2 and the shapes of the connection terminals A1, A2, B1 and B2 are determined such that they can be fitted into the sockets 26 and 27 of the body 25 of an illumination device 20 for a linear fluorescent lamp shown in FIG. 9.

Although the characteristic setting unit 2 is not shown in FIG. 2, it can be mounted by using electronic parts to be described later on the substrate identical to the substrate on which the plurality of LEDs LED1 are mounted, and is also mounted near the connection terminals B1 and B2. The light source unit 1 and the characteristic setting unit 2 which constitute the LED module 21 are connected to the lighting apparatus, configured as shown in the block diagram of FIG. 3, via the connection terminals A1, A2, B1 and B2.

Figure 3:
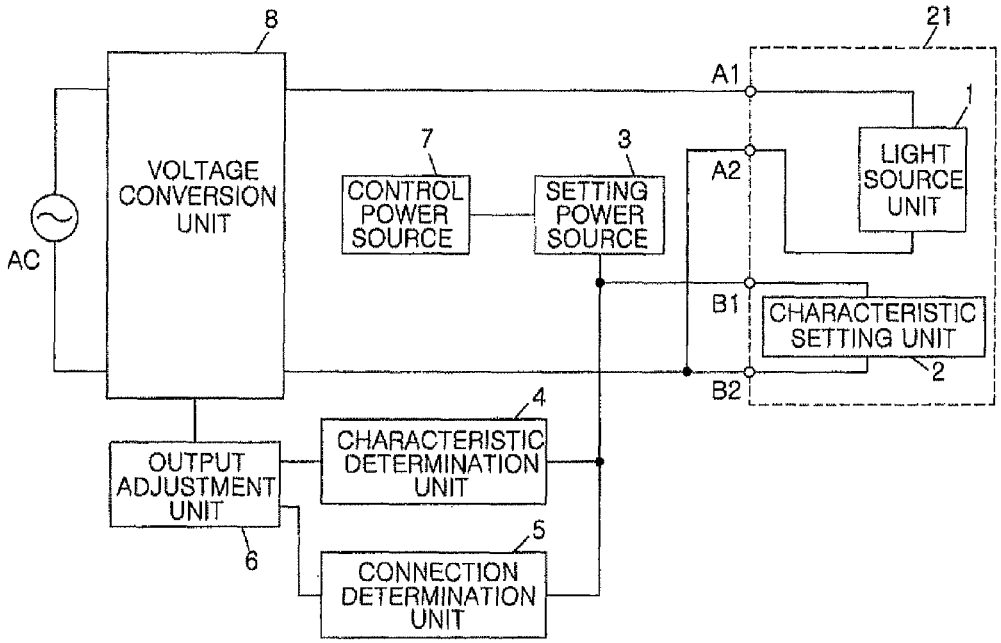
FIG. 3 is a circuit diagram of a lighting apparatus in accordance with the first embodiment of the present invention.

The lighting apparatus of FIG. 3 includes a voltage conversion unit 8 which has at least one switching device (not shown) and supplies a current to the LED module 21 and light the LED module 21 by selectively turning on and off the switching device, an output adjustment unit 6 for outputting a driving signal to the switching device of the voltage conversion unit 8 in order to obtain desired output, a control power source 7 for supplying control power to a control circuit such as the output adjustment unit 6, a setting power source 3 for receiving the power supplied from the control power source 7 and supplying control power to the characteristic setting unit 2, a characteristic determination unit 4 for detecting a waveform at a wire through which the control power is supplied from the setting power source 3 to the characteristic setting unit 2, and controlling the output adjustment unit 6 based on the detection result, and a connection determination unit 5 for determining whether the LED module 21 is connected to the lighting apparatus or not.

When it is assumed that the electrical characteristics of the LEDs LED1 of the LED module 21 shown in FIG. 1 are, for example, 0.3 A and 3.5 V and 50 LEDs are connected in series, the current supplied from the voltage conversion unit 8 to the light source unit 1 is 0.3 A, so that the voltage across both ends of the light source unit 1 is 3.5 V×50=175 V, and the power consumption of the light source unit 1 is 3.5 V×0.3 A×50=52.5 W.

The voltage conversion unit 8 may be formed of, for example, a step-down chopper or a combination of a step-up chopper and a step-down chopper. The voltage conversion unit 8 may be formed of any configuration as long as the configuration supplies DC power which can light up the LED module 21.

The characteristic setting unit 2 is configured to have information about respective set currents so that a current from the voltage conversion unit 8 can be supplied at a desired level in a range of, e.g., 0.35 A to 0.10 A. Since the LEDs LED1 of the above example require a current of 0.3 A, the characteristic setting unit 2 of the LED module 21 using the LEDs LED1 is configured to have information indicative of a set current of 0.3 A.

Figure 4:
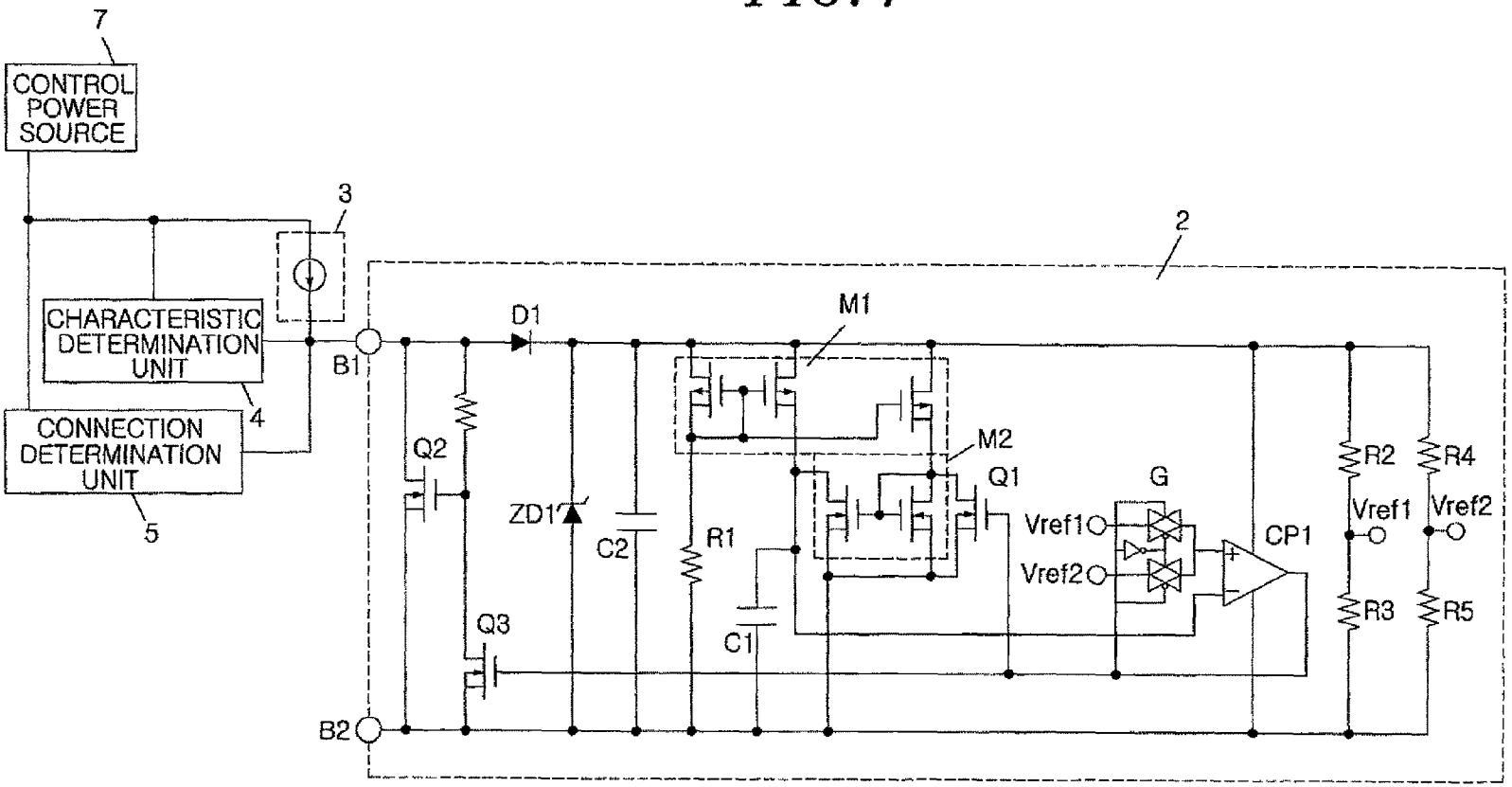
FIG. 4 is a circuit diagram of a detailed configuration of a characteristic setting unit in accordance with the first embodiment of the present invention.

FIG. 4 shows a more detailed configuration of the characteristic setting unit 2. The setting power source 3 of the present embodiment chiefly includes a current source, and supplies control power to the characteristic setting unit 2 via the connection terminal B1 as described above.

Furthermore, the output adjustment unit 6 is controlled by inputting the waveform on a wire having the same electric potential as the connection terminal B1 to the characteristic determination unit 4 and the connection determination unit 5.

The control power inputted between the connection terminals B1 and B2 from the setting power source 3 is inputted to a parallel circuit of a Zener diode ZD1 and a capacitor C2 via a diode D1. The control power is clamped to the Zener voltage Vz1 of the Zener diode ZD1, and is smoothed by the capacitor C2. The Zener current flowing through the Zener diode ZD1 can be limited to an appropriate value by using a constant current source as the setting power source 3, as shown in FIG. 4. Zener voltage Vz1 obtained by clamping the control power inputted from the setting power source 3 is chiefly supplied to mirror circuits M1 and M2, a comparator CP1, a transfer gate circuit G, a series circuit of the resistors R2 and R3, and a series circuit of the resistors R4 and R5.

The series circuit of resistors R2 and R3 produces a reference voltage Vref1 by dividing the Zener voltage Vz1 by the resistors R2 and R3. The series circuit of resistors R4 and R5 produces a reference voltage Vref2 by dividing the Zener voltage Vz1 by the resistors R4 and R5. The reference voltages Vref1 and Vref2 are supplied to the + input terminal of the comparator CP1 via the transfer gate circuit G. The mirror circuit M1 supplies a current i1, determined by the resistor R1, to the capacitor C1 and the mirror circuit M2. A current i2 flowing through the mirror circuit M2 changes the mirror ratio, and is set to be greater than i1.

When a switching device Q1 which is selectively turned on and off in response to an output signal of the comparator CP1 is turned on, i2 becomes 0, so that the current i1 is discharged to the capacitor C1. When the switching device Q1 is turned off, a current (i1-i2) becomes a negative current, so that the current (i2-i1) is drawn from the capacitor C1.

Figure 5:
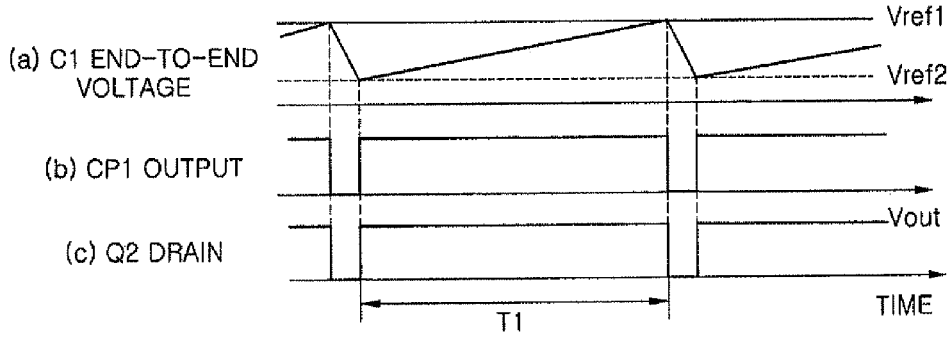
FIG. 5 is a waveform diagram showing an operation of the characteristic setting unit in accordance with the first embodiment of the present invention.

The voltage waveform of the capacitor C1 is forced to assume a triangular voltage waveform having charging time T1 as shown in FIG. 5(*a*) by switching, using the transfer gate circuit G, between the reference voltages Vref1 and Vref2 in response to the output voltage of the comparator CP1 as shown in FIG. 5(*b*).

Further, the output of the comparator CP1 is inputted to a gate of a switching device Q3, and a switching device Q2 is selectively turned on and off by selectively turning on and off the switching device Q3. Since the drain of the switching device Q2 is connected to a wire having an electric potential identical to that of the connection terminal B1, the drain voltage of the switching device Q2, i.e., the voltage of the connection terminal B1, forms a waveform having a period "H" almost identical to the charging time T1 of the capacitor C1, as shown in FIG. 5(*c*).

When the switching device Q2 is off, the voltage of the connection terminal B1 is a voltage value Vout of the sum of an ON voltage of the diode D1 and the Zener voltage Vz1 of the Zener diode ZD1. Furthermore, when the switching device Q2 is on, a current of the control power inputted from the setting power source 3 flows through the switching device Q2, in which case the circuit operation is continuously performed using the voltage charged in the smoothing capacitor C2.

Figure 6:
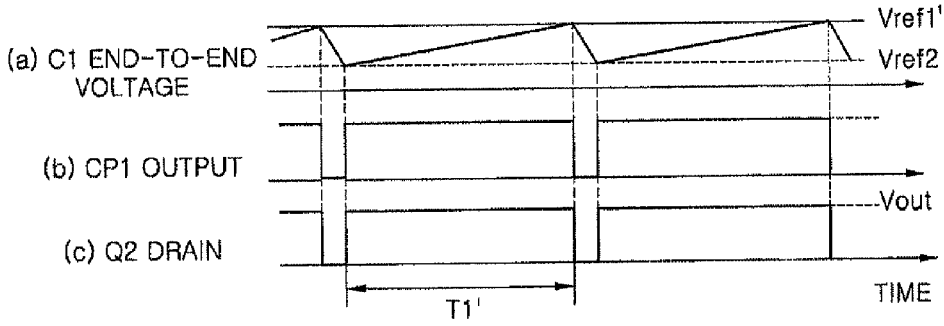
FIG. 6 is a waveform diagram showing an operation of the characteristic setting unit when the characteristic setting unit has been set differently in accordance with the first embodiment of the present invention.

Here, when the voltage division ratio of the resistors R2 and R3 is changed to generate a reference voltage Vref1' which is lower than the reference voltage Vref1 produced by the series circuit of the resistors R2 and R3, the charging time of the capacitor C1 becomes a period T1' which is shorter than the period T1, as shown in FIG. 6(*a*). In this case, the period "H" of the drain voltage of the switching device Q2, i.e., of the voltage of the connection terminal B1, has almost the same waveform as the shorter period T1', as shown in FIG. 6(*c*).

Figure 7:
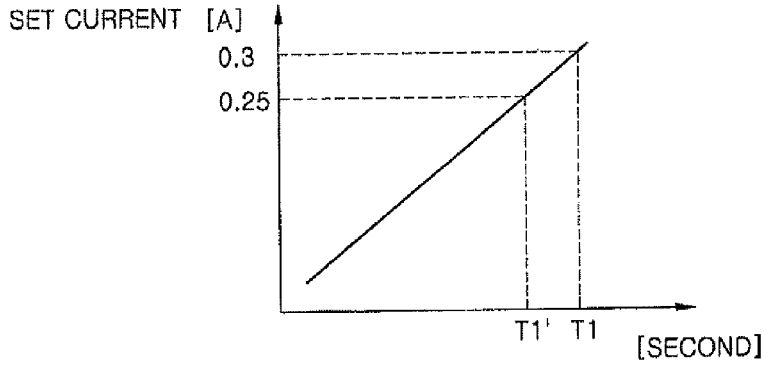
FIG. 7 is a graph for describing an operation of a characteristic determination unit in accordance with the first embodiment of the present invention.

The characteristic determination unit 4 is formed chiefly of a microcomputer, and performs a time measuring process to measure the period "H" of the voltage of the connection terminal B1. Further, the characteristic determination unit 4 obtains a set current corresponding to the measured time by means of an operation, in which case the set current and the measured time have the relationship shown in FIG. 7. Alternatively, the characteristic determination unit 4 reads the set current from a previously stored data table. The characteristic determination unit 4 outputs an operation signal to the output adjustment unit 6 so that the output adjustment unit 6 can adjust its output to the set current which has been obtained as described above.

When, for example, an LED module 21 in which 50 LEDs LED1 having electrical characteristics of 0.3 A and 3.5 V have been connected in series is connected to the lighting apparatus, the period "H" of the voltage of the connection terminal B1 determined by the characteristic setting unit 2 is set to be the period T1 shown in FIG. 5. When an LED module 21' in which 40 LEDs having different characteristics of, for example, 0.25 A and 3.5 V have been connected in series is connected to the lighting apparatus, the period "H" of the voltage of the connection terminal B1 determined by the characteristic setting unit 2 is set to be the period T1' shown in FIG. 6.

By doing so, the length of the period "H" of the voltage of the connection terminal B1 determined by the characteristic setting unit 2 is forced to be equal to information corresponding to the set current supplied to the LED module 21.

Next, the operation of the connection determination unit 5 which receives as an input the waveform on a wire having electric potential identical to that of the connection terminal B1, like the characteristic determination unit 4, will be described. The connection determination unit 5 is formed of a microcomputer, like the characteristic determination unit 4, or a comparator and is configured to detect the voltage value of the connection terminal B1. When the LED module 21 is connected to the lighting apparatus, the voltage of the connection terminal B1 is the voltage value Vout of the sum of the ON voltage of the diode D1 and the Zener voltage Vz1 of the Zener diode ZD1.

Meanwhile, when the LED module 21 is disconnected, clamping is not performed by the Zener voltage Vz1 of the Zener diode ZD1, so that a voltage value higher than the voltage value Vout is achieved. Using this relationship, the connection determination unit 5 determines that the LED module 21 has not been connected if the voltage value of the connection terminal B1 is higher than a predetermined value Vref3 (see FIG. 8(*a*)).

If it is determined that the LED module 21 has not been connected, the connection determination unit 5 outputs a stop signal to the output adjustment unit 6 to cut off the supply of current from the voltage conversion unit 8 to the LED module 21. Although not shown, it is preferable, in response to the stop signal, to stop an information determination and a set current adjustment in the characteristic determination unit 4 which are performed according to the information of the characteristic setting unit 2. In this case, the characteristic determination unit 4 and the connection determination unit 5 may be formed of the same microcomputer.

Figure 8:
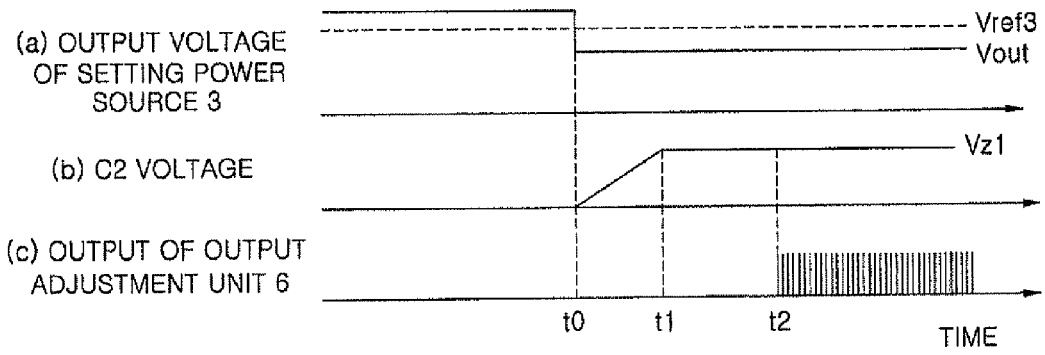
FIG. 8 is a diagram showing waveforms of respective parts when an operation starts in accordance with the first embodiment of the present invention.

A timing chart shown in FIG. 8 depicts a sequence operation when the LED module 21 is connected. Up to time to, the LED module 21 has not been connected. Here, as shown in FIG. 8(*a*), the output voltage of the setting power source 3 is higher than the predetermined threshold value Vref3 that is used to determine the non-connection of the LED module 21. As a result, as shown in FIG. 8(*c*), a driving signal is not outputted from the output adjustment unit 6 to the voltage conversion unit 8.

Thereafter, when the LED module 21 is connected at time to, the electric potential of the smoothing capacitor C2 is gradually increased by the control power which is supplied as a constant current to the characteristic setting unit 2 of the LED module 21 from the setting power source 3, as shown in FIG. 8(*b*), and becomes equal to the Zener voltage Vz1 of the Zener diode ZD1 at time t1.

During a period from time t0 to time t1, the characteristic setting unit 2 does not stably operate, so that the characteristic determination unit 4 may make an erroneous determination. Accordingly, a timer for stopping the information determination of the characteristic determination unit 4 is provided in the period from time t0 at which the connection determination unit 5 determines that the LED module 21 has been connected to time t1 at which the operation of the characteristic setting unit 2 is stabilized. Thereafter, the information determination of the characteristic determination unit 4 starts from time t1, and the output adjustment unit 6 outputs a driving signal from time t2 at which the information determination and the set current adjustment has been completed.

By using the above configuration, the characteristic information of the LEDs LED1 used in the LED module 21 can be previously set and the lighting apparatus can supply an appropriate set current based on the set information, so that damage of the LEDs LED1 or a decrease in the life span thereof due to the supply of an excessive current is not caused. Furthermore, since it is possible to determine whether the LED module 21 has been connected or not on the same wire on which the characteristic information of the LEDs LED1 is determined, the wiring is saved and the operation of the lighting apparatus is stopped when the LED module 21 is disconnected, thereby preventing excessive power consumption.

Furthermore, since the connection terminals A1 and A2 and the connection terminals B1 and B2 are electrically connected, as shown in FIG. 3, there is no worry over the electric shock although a user or a worker erroneously touches the connection terminals B1 and B2 while inserting the connection terminals A1 and A2 into the socket when replacing or attaching the LED module.

In the present embodiment, the set current flowing to the LED module 21 has been taken as an example of the information given by the characteristic setting unit 2, but it may be information based on the voltage applied to the LED module 21.

Furthermore, although a circuit configuration of the control power source 7 has not been exemplified, the circuit of the control power source 7 may be configured using a common technology. For example, when an inductor is used in the voltage conversion unit 8, the circuit of the control power source 7 may be configured using power returning from the secondary coil of the inductor.

In the present embodiment, the LED module 21 has been described as being configured to have the distance between the terminals and the shape of the terminals which are suitable to be fitted into the sockets 26 and 27 (see FIG. 9). However, the effects of the present embodiment can still be achieved even though the distance between the terminals and the shape of the terminals are changed, on condition that one pin base is provided with two terminals. In this case, it is necessary to newly develop the sockets 26 and 27 in accordance with the distance between the terminals and the shape of the terminals, but the body 25 of the illumination device 20 may be used without any changes.

Embodiment 2

Figure 10:
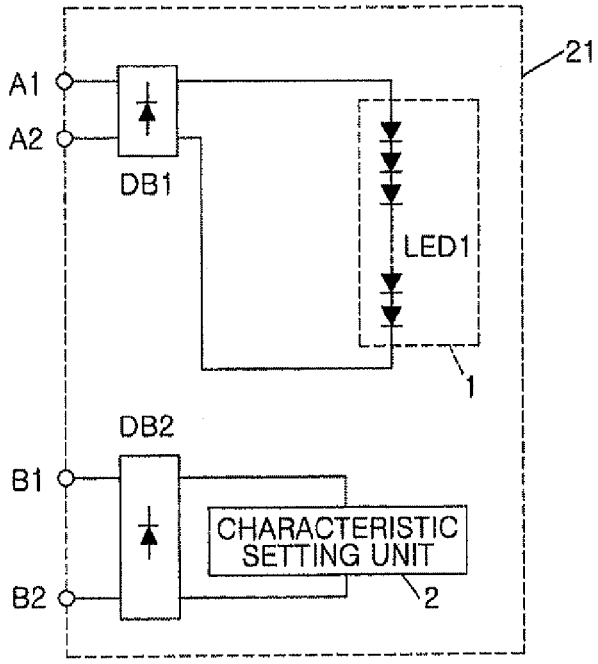
FIG. 10 is a circuit diagram of an LED module in accordance with a second embodiment of the present invention.

FIG. 10 is a diagram showing a circuit configuration of an LED module in accordance with a second embodiment of the present invention. The configuration of a lighting apparatus according to the present embodiment is the same as that of the first embodiment. The LED module of the present embodiment is different from that of the first embodiment in that connection terminals A1 and A2 are connected to the input terminal of a rectifier DB1, the positive output side of the output terminal of the rectifier DB1 is connected to the anode side of a light source unit 1, and the negative output side of the output terminal of the rectifier DB1 is connected to the cathode side of the light source unit 1. Furthermore, with regard to a characteristic setting unit 2, control power supplied from a setting power source 3 constituting part of the lighting apparatus to the connection terminals B1 and B2 is supplied to the characteristic setting unit 2 via a rectifier DB2.

Although the detailed configuration of the characteristic setting unit 2 has not been illustrated, any configuration may be used as long as the configuration is adapted to previously set the characteristic information of the LEDs LED1 and enable the lighting apparatus to supply an appropriate set current according to the set information, as described in conjunction with the first embodiment.

In the first embodiment, each of the connection terminals A1 and A2 or each of the connection terminals B1 and B2 has a polarity. Therefore, if the lighting apparatus and the LED module are wrongly connected to each other, the LED module may not be lit up or the characteristic information of LEDs used may not be correctly read. In contrast, according to the configuration of the LED module in the present embodiment, there is no polarity between the connection terminals A1 and A2 and between the connection terminals B1 and B2, so that there is less malfunction attributable to erroneous connection and it is possible to omit a protection function which is required when a unstable phenomenon occurs upon erroneous connection.

Furthermore, as in the first embodiment (FIG. 1), the connection terminals A1 and A2 of the LED module 21 are electrically insulated from the connection terminals B1 and B2 thereof, and the lighting apparatus supplies an appropriate set current depending on the characteristic information of the LEDs LED1. Accordingly, the electric shock and the damage and degradation of the LEDs are not caused.

Figure 11:
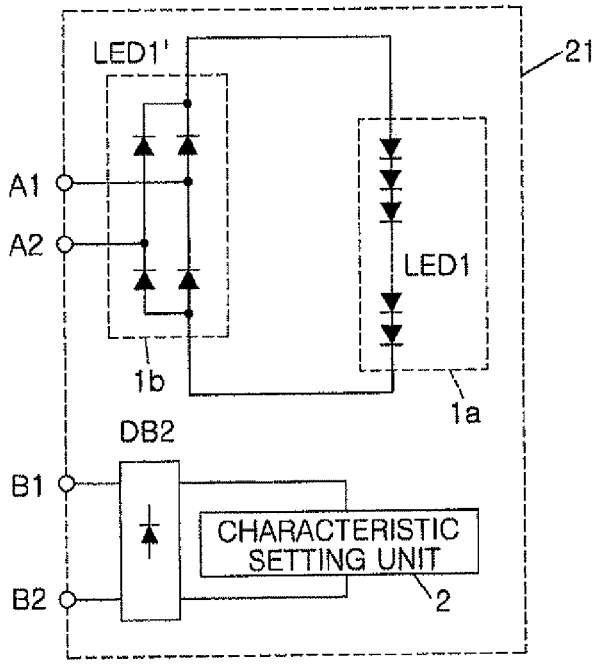
FIG. 11 is a circuit diagram of a variation of the LED module in accordance with the second embodiment of the present invention.

FIG. 11 shows another example of a configuration of the LED module in accordance with the second embodiment of the present invention. In this example, a light source unit connected between the connection terminals A1 and A2 includes a light source unit 1*b* configured such that 4 LEDs are combined to be subjected to full-wave rectification and a light source unit 1*a* configured to receive a rectification output from the light source unit 1*b*. This example is different in that the light source unit 1*b* in which the LEDs LED1 are combined to be subjected to full-wave rectification functions as the rectifier DB1 of the LED module 21 of FIG. 10 and also functions as a light emission unit.

Embodiment 3

Figure 12:
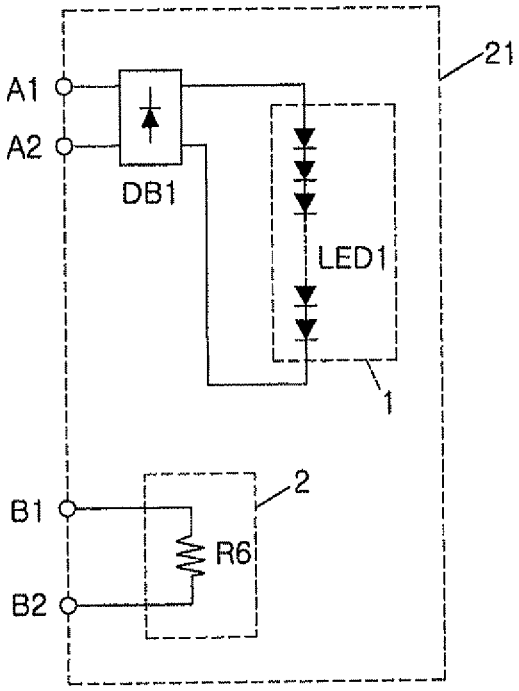
FIG. 12 is a circuit diagram of an LED module in accordance with a third embodiment of the present invention.

FIG. 12 shows a circuit configuration of an LED module in accordance with a third embodiment of the present invention. The basic configuration of the LED module of this embodiment is almost the same as that of the second embodiment. However, the detailed configuration of a contained characteristic setting unit 2 is different from that of the second embodiment in that it includes a resistor R6.

Figure 13:
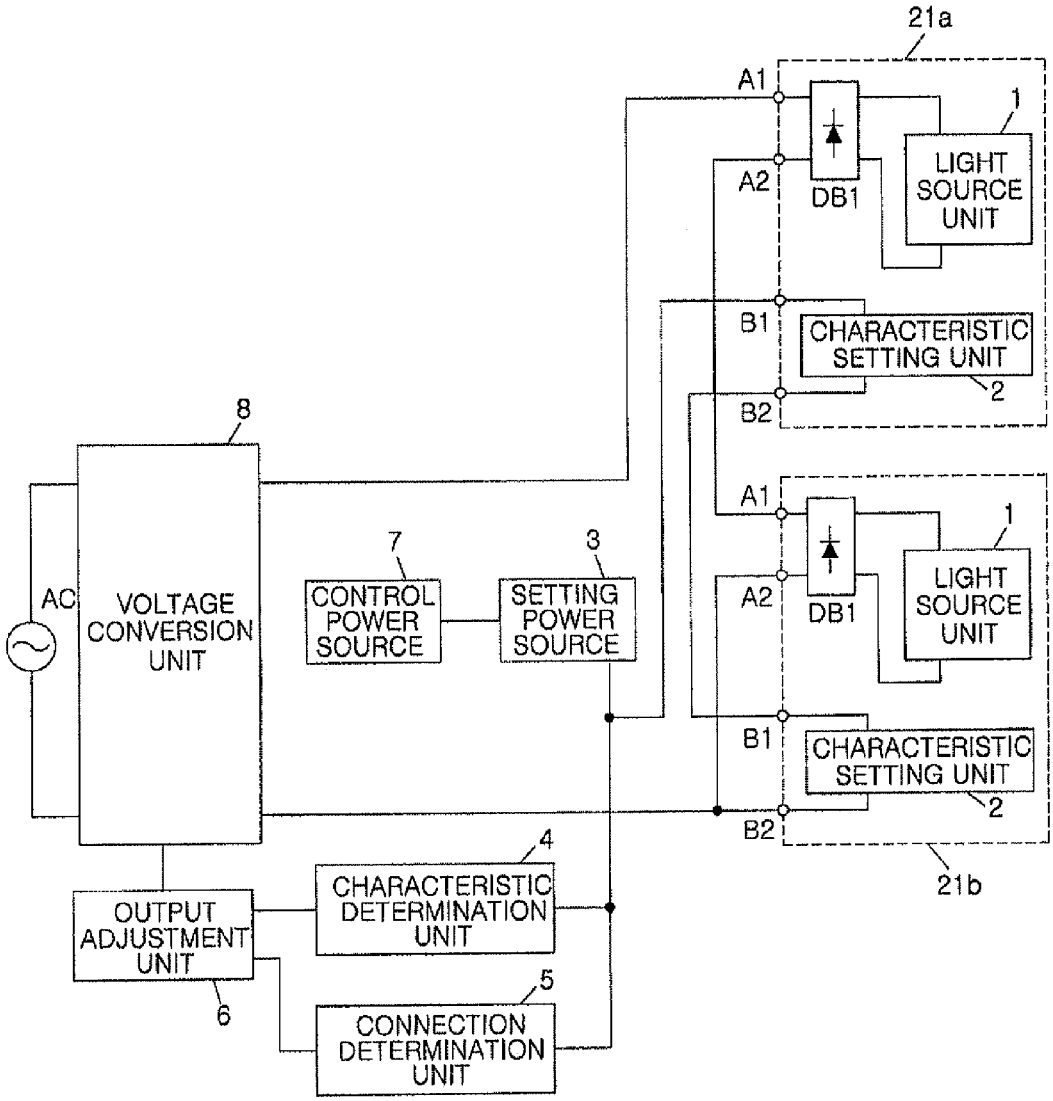
FIG. 13 is a circuit diagram of a lighting apparatus in accordance with the third embodiment of the present invention.

A lighting apparatus is configured almost the same as that of the first embodiment (shown in FIG. 3), as shown in the block diagram of FIG. 13. As seen from FIG. 13, the difference resides in that the internal wiring of the illumination device is configured to connect the LED module 21*a* and the LED module 21*b* in series to each other.

The output terminal of the voltage conversion unit 8 of the lighting apparatus is connected to the connection terminal A1 of the LED module 21*a* and the connection terminal A2 of the LED module 21*b*, and the connection terminal A2 of the LED module 21*a* is connected to the connection terminal A1 of the LED module 21*b*. The output terminal of the setting power source 3 of the lighting apparatus is connected to the connection terminal B1 of the LED module 21*a* and the connection terminal B2 of the LED module 21*b*, and the connection terminal B2 of the LED module 21*a* is connected to the connection terminal B1 of the LED module 21*b*. Accordingly, control power is supplied from the setting power source 3 to a series circuit of the characteristic setting unit 2 of the LED module 21*a* and the characteristic setting unit 2 of the LED module 21*b*.

In this example, the setting power source 3 is desirably formed of a constant current source, as in the first and second embodiments, and is configured to determine information based on a voltage value obtained by multiplying current Iref supplied by the constant current source by the resistance value Rset of the resistor R6 of the characteristic setting unit 2.

Figure 14:
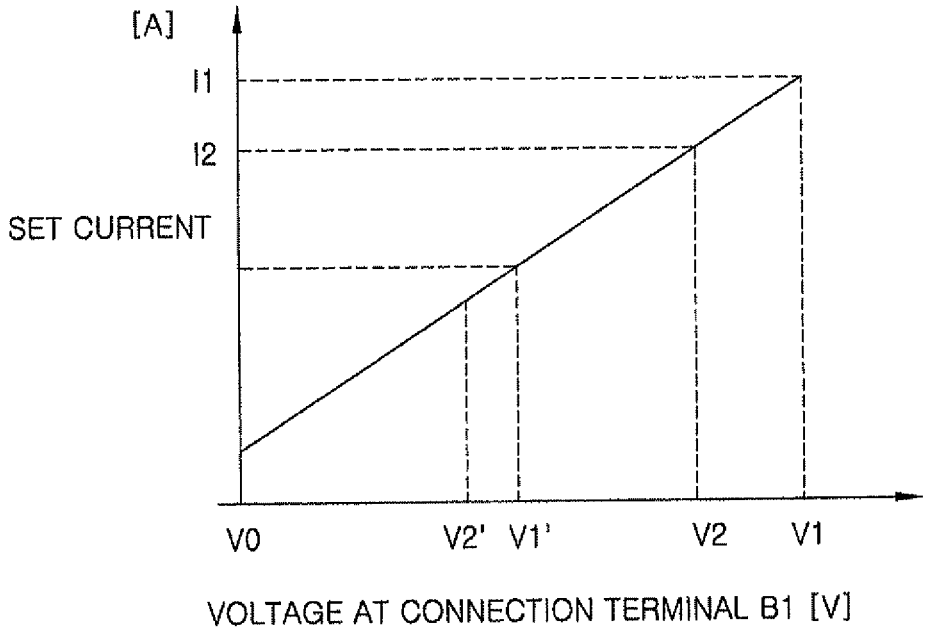
FIG. 14 is a graph for describing an operation of a characteristic determination unit in accordance with the third embodiment of the present invention.

FIG. 14 is a graph showing the relationship between characteristic setting information and a set current. The characteristics information of the LEDs LED1 is configured to have output characteristics, such as those shown in FIG. 14, by changing, e.g., the constant of the resistance value Rset of the resistor R6 of the characteristic setting unit 2.

When the same current is supplied to the LED module 21*a* and the LED module 21*b*, the resistance values Rset of the resistors R6 of the characteristic setting units 2 are preferably the same. When a voltage signal input to the characteristic determination unit 4 is V1, V1=2×V1'=2×Rset×Iref, in which case a current I1 is supplied to the LED module 21*a* and the LED module 21*b*.

Specifically, as one example, it is assumed that the LED modules 21*a* and 21*b* in each of which LEDs LED1 having electrical characteristics of, e.g., 0.3 A and 3.5 V are connected in series are connected to the lighting apparatus. When the resistance values Rset of the resistors R6 of the characteristic setting units 2 are set to 20 kΩ and the above current source Iref is set to 100 μA, a signal of 2×20 kΩ×100 μA=4 V is inputted to the characteristic determination unit 4. In this case it is desirable to control the current supplied to the LED modules 21*a* and 21*b* to become 0.3 A.

As another example, it is assumed that LEDs LED2 having different electrical characteristics, which are, e.g., 0.25 A and 3.5V, are used, and the LED modules 21*a* and 21*b* in which the LEDs LED2 are connected in series are connected to the lighting apparatus. When resistance values Rset' of the resistors R6 of the characteristic setting units 2 are set to be lower than Rset, it is desirable to control the current I2 supplied to the LED modules 21*a* and 21*b* to become 0.25 A, in response to a signal V2 inputted to the characteristic determination unit 4.

Furthermore, when the level of a signal inputted to the connection determination unit 5 is higher than V1, it is determined that the LED module has not been connected, in which case a stop signal is outputted to the output adjustment unit 6 to cut off the supply of current from the voltage conversion unit 8 to the LED module. Accordingly, when at least one of the characteristic setting units 2 of the LED module 21*a* and the LED module 21*b* is not properly contacted, the connection determination unit 5 may cut off the supply of current to the LED module.

If output characteristics are exhibited as shown in FIG. 14 even when the characteristic setting unit 2 is short-circuited due to bad wiring, it is possible to control the supply of current to the LED module to become a minimum current value.

Additionally, when one of two LED modules is formed of LEDs LED1 having electrical characteristics of 0.3 A and 3.5 V, the other LED module is formed of LEDs LED2 having electrical characteristics of 0.25 A and 3.5 V, and two LED modules of these two types are connected in series and are then lit up, a signal inputted to the characteristic determination unit 4 is higher than V2 and lower than V1 as seen from the output characteristics shown in FIG. 14, so that excessive current I1 can be prevented from being supplied to the LED module formed of LEDs LED2.

The present embodiment provides the same effects as the first and second embodiments. When a plurality of LED modules are connected, the wiring connected from the setting power source to the characteristic setting units of the plurality of LED modules and the wiring connected to the light source unit can be relatively simplified.

Furthermore, in the lighting apparatus, a plurality of LED modules can be connected, so that it is not necessary to complicate the circuit configuration except for the configuration regarding the addition of terminals, and it is possible to easily implement the lighting apparatus at low cost.

Embodiment 4

Figure 15:
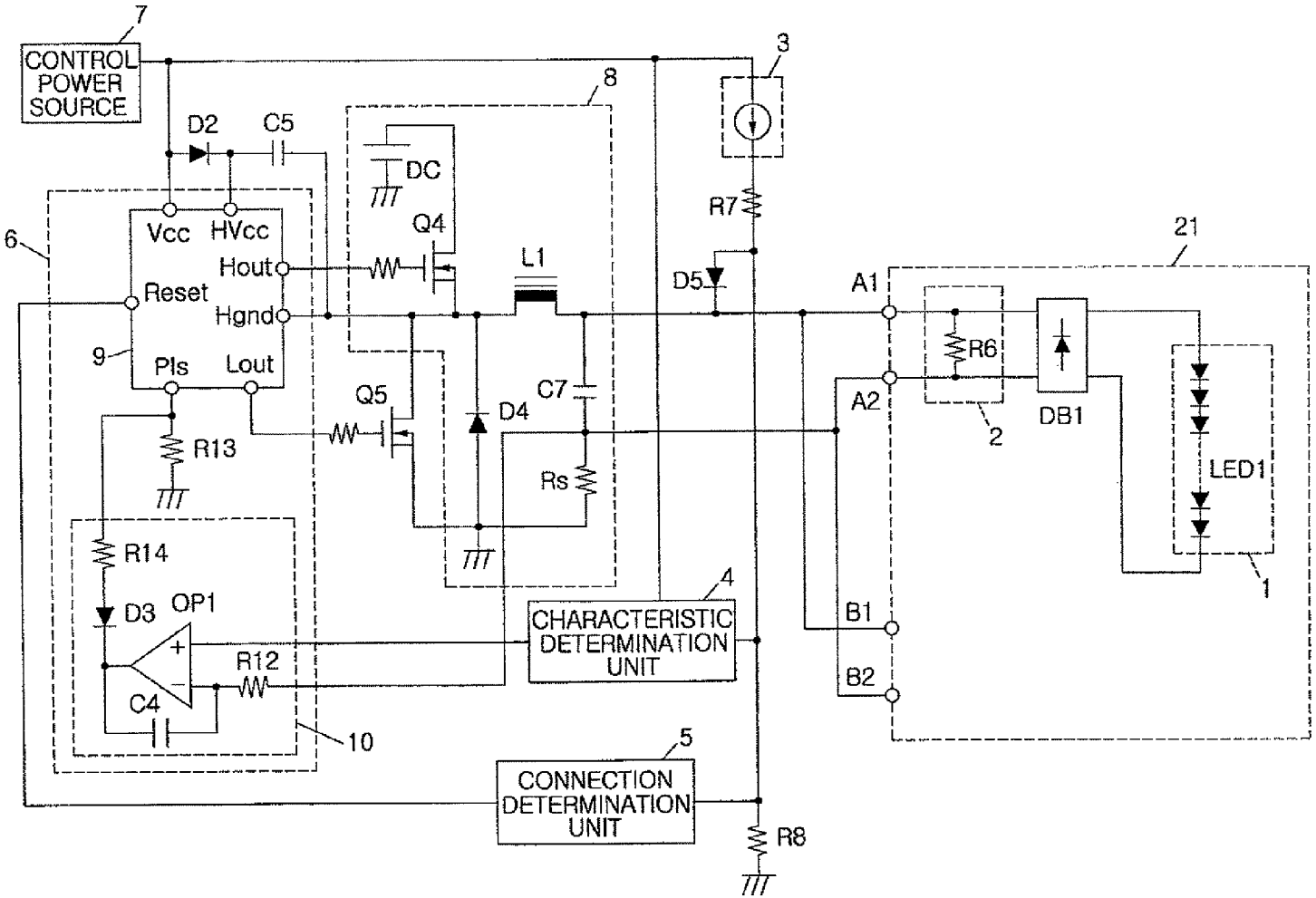
FIG. 15 is a circuit diagram of a lighting apparatus in accordance with a fourth embodiment of the present invention.

FIG. 15 shows a circuit configuration of a lighting apparatus in accordance with a fourth embodiment of the present invention. In this embodiment, a voltage conversion unit 8 is formed of a commonly-known step-down chopper circuit. The voltage conversion unit 8 inputs DC power which is generated by rectifying and smoothing AC power or by stepping up DC power using the step-up chopper circuit. The drain side of a switching device Q4 is connected to the positive output terminal of the DC power source DC, and a current is supplied to a smoothing capacitor C7 and connection terminals A1 and A2 of an LED module 21 via an inductor L1 connected to the source side of the switching device Q4.

The ON and OFF operation of the switching device Q4 is performed in response to a driving signal outputted from a Haut terminal of a driving circuit 9 of an output adjustment unit 6. When the switching device Q4 is turned on, a current flows to an inductor L1 and, therefore, electronic energy is stored therein. When the switching device Q4 is turned off, the electronic energy stored in the inductor L1 is discharged via a diode D4 connected between the source of the switching device Q4 and the ground.

Although the basic configuration of the LED module 21 is almost the same as that of the third embodiment, a characteristic setting unit 2 is formed of a resistor R6 and is connected between the connection terminals A1 and A2. A setting power source 3 which supplies control power to the characteristic setting unit 2 is formed of a constant current source, and supplies the control power to the characteristic setting unit 2 connected between the connection terminal A1 and the connection terminal A2, via a series circuit of a resistor R7 and a diode D5. Also, the control power is supplied to a resistor R8 connected between the ground and a junction between the resistor R7 and the diode D5.

Furthermore, a resistor Rs is provided between the ground and the connection terminal A2 to which the cathode side of the LEDs LED1 of the light source unit 1 of the LED module 21 is connected. The current flowing through the light source unit 1 flows to the ground via the resistor Rs. A current charged in the smoothing capacitor C7 flows through the resistor Rs. Accordingly, the total current of the current flowing through the LED module 21 and the current flowing through the smoothing capacitor C7 is detected at the resistor Rs.

A detected voltage obtained by multiplying the resistance value of the resistor Rs by the flowing current is inputted to a feedback operation circuit 10 of the output adjustment unit 6. The feedback operation circuit 10 is formed chiefly of an operational amplifier (op-amp) OP1. The above detected signal is inputted to the negative input terminal of the op-amp OP1 via a resistor R12. A capacitor C4 is connected between the negative input terminal and output terminal of the op-amp OP1, thereby forming a commonly-known integration circuit.

Meanwhile, a set signal outputted from the characteristic determination unit 4 and based on information set by the LED module 21 is inputted to the positive input terminal of the op-amp OP1. An integration operation is performed on the set signal and the detected signal, and operation results are outputted from the output terminal of the op-amp OP1. The output terminal of the op-amp OP1 is connected to a Pls terminal of the driving circuit 9 via a resistor R14 and a diode D3. The Pls terminal is a terminal for controlling the ON pulse width of the switching device Q4 which is performed by the driving circuit 9.

Next, the operation of the Pls terminal of the driving circuit 9 will be described briefly. In the driving circuit 9, circuits connected to the Pls terminal include, e.g., a constant voltage buffer circuit, a mirror circuit, and a driving signal setting capacitor. A current flowing through a resistor R13 connected between the Pls terminal, i.e., the output of the constant voltage buffer circuit, and the ground is converted by the mirror circuit, and the driving signal setting capacitor is selectively charged and discharged, as is well known.

Figure 16:
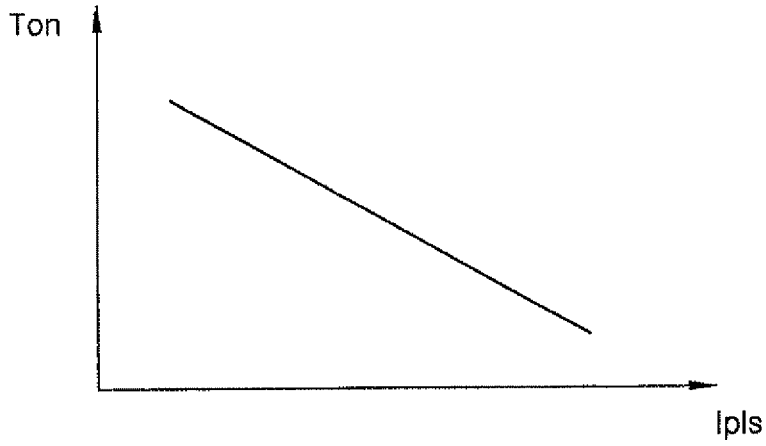
FIG. 16 is a characteristic graph for describing an operation of the lighting apparatus in accordance with the fourth embodiment of the present invention.

If the period of time taken by the driving signal setting capacitor to be charged up to a predetermined voltage is almost the same as Ton representing the period "H" of the driving signal outputted to the switching device Q4, the relationship between the current Ipls flowing from the Pls terminal to the resistor R13 and the Ton representing the period "H" of the driving signal, is set as shown in FIG. 16. That is, Ton, i.e., the period "H" of the driving signal decreases as the current Ipls discharged from the Pls terminal increases.

Here, return to the description of the operation of the feedback operation circuit 10. For example, when the current flowing through the inductor L1 increases, the level of the signal detected at the resistor Rs also increases. In this case, an output voltage of the op-amp OP1 of the feedback operation circuit 10 decreases, and a current drawn from the Pls terminal to the op-amp OP1 increases. Accordingly, the current Ipls discharged from the Pls terminal increases. As the current Ipls discharged from the Pls terminal increases, the driving circuit 9 performs control to reduce Ton representing the period "H" of the driving signal outputted from the Hout terminal. Accordingly, an increase in the current of the inductor L1 is suppressed, and thus, the current supplied to the LED module 21 is reduced.

In the driving circuit 9, the control power for the control circuit which is used to output a driving signal from the Hout terminal to the switching device Q4 is obtained by charging a capacitor C5 via a diode D2. Since this configuration can be easily implemented using the technology of a half bridge driving circuit which is used as an inverter circuit for a fluorescent lamp, a detailed description thereof will be omitted here, but the description of the function of a switching device Q5 will be supplemented.

Figure 18:
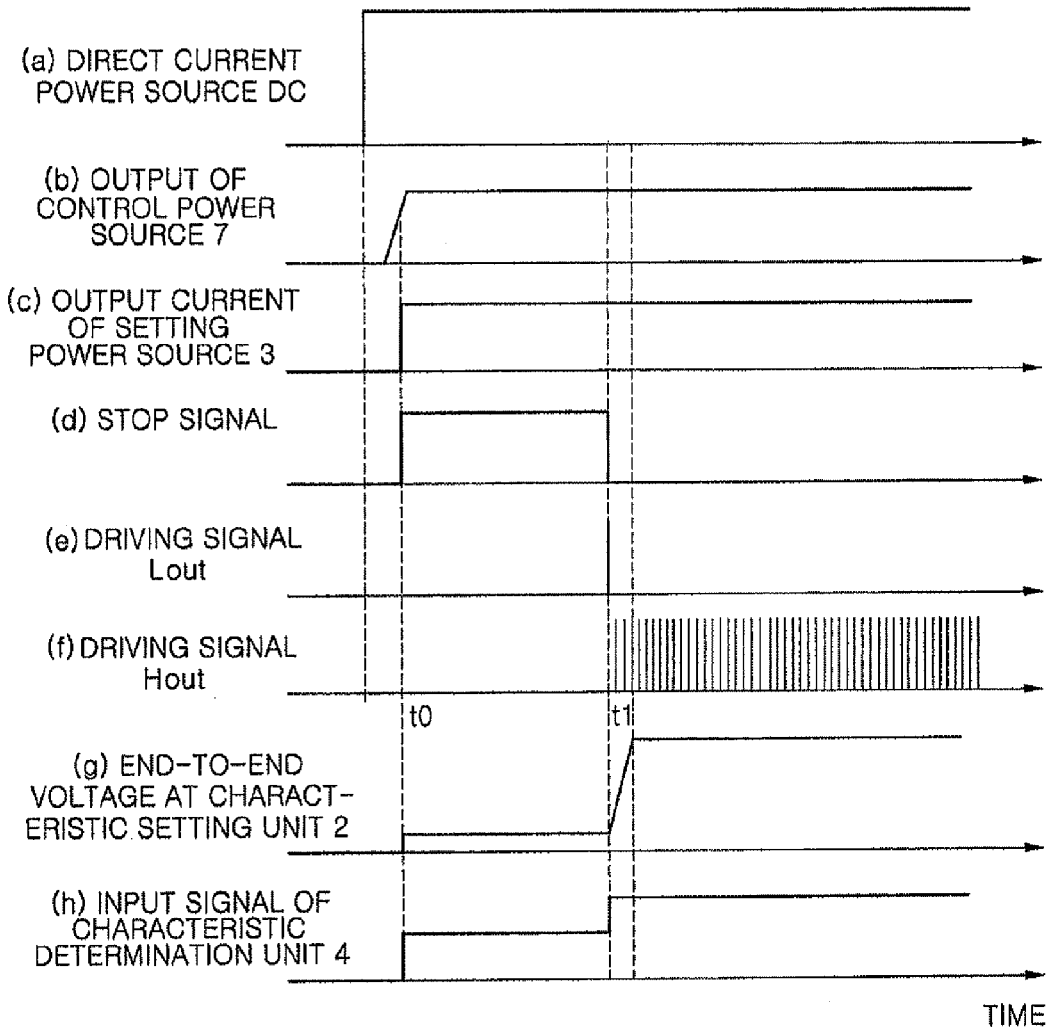
FIG. 18 is a diagram showing waveforms of respective parts when an operation starts in accordance with the fourth embodiment of the present invention.

If a voltage is being generated at the source of the switching device Q4 before a driving signal starts to be outputted from the Hout terminal, the capacitor C5 is unable to be charged with a control power voltage which is sufficient to drive the gate of the switching device Q4. Therefore, it is desirable to provide the switching device Q5 between the source of the switching device Q4 and the ground, as shown in FIG. 15, make an electric potential of the source of the switching device Q4 almost 0 V by first turning on the switching device Q5, and then perform ON and Off control of the switching device Q4. The timing charts of the driving signals Lout and Hout which are used to drive the switching devices Q5 and Q4 are shown in FIGS. 18(*e*) and 18(*f*).

Next, the operation of the characteristic setting unit 2, characteristic determination unit 4 and connection determination unit 5 of the present embodiment will be described below.

When the resistance value of the resistor Rs is less than several Ω and the resistance value of the resistor R6 of the characteristic setting unit 2 of the LED module 21 is higher than several tens of kΩ, the influence of the resistor Rs on the resistor R6 is within an error level, so that the resistor Rs is considered not to be present here for ease of description. Furthermore, the diode D5 will also not be considered as being present.

Figure 17:
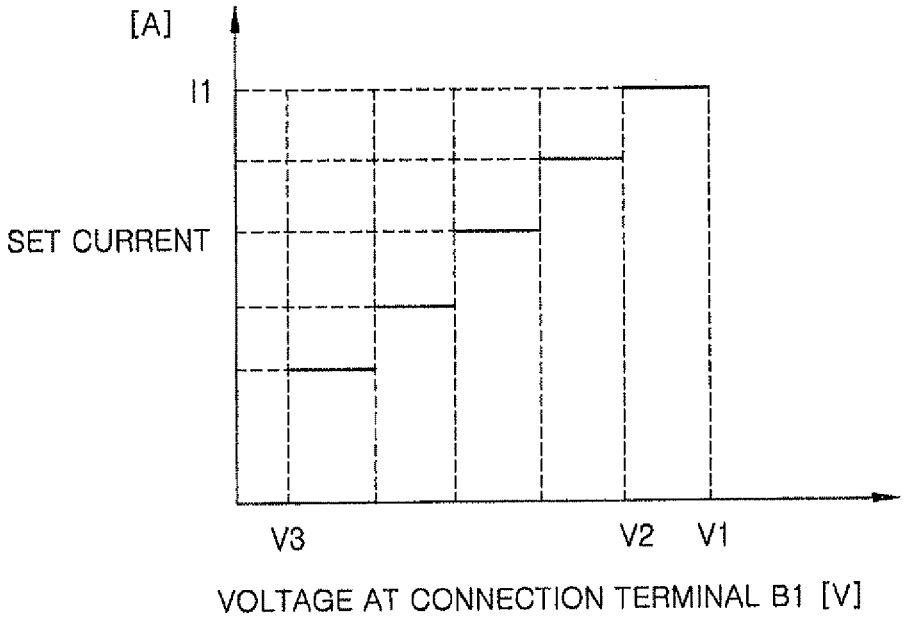
FIG. 17 is a characteristic graph showing a relationship between characteristic setting information and a set current in accordance with the fourth embodiment of the present invention.

When the LED module 21 has been connected and the switching device Q4 is not performing a switching operation, a voltage occurring at the connection terminal B1 has a voltage value which is determined based on the current value Iref supplied from the setting power source 3 to the resistor R6 and the resistance value Rset of the resistor R6. A set current is determined based on the voltage value and the relationship, such as that shown in FIG. 17.

In the first to third embodiments, the current supplied to the LED module has been set to continuously vary depending on the voltage value occurring at the characteristic setting unit 2. However in the present embodiment, the constant current I1 is supplied to the LED module when the voltage value occurring at the characteristic setting unit 2 is equal to or less than V1 and higher than V2.

When the LED module 21 has not been connected, the constant current supplied by the setting power source 3 is supplied to the resistor R8 via the resistor R7. In this case, by setting a voltage across both ends of the resistor R8 to higher than V1, whether the LED module 21 is connected or not may be determined by the comparison between the voltage and a predetermined reference voltage in the connection determination unit 5. When the LED module 21 is disconnected, a stop signal is outputted from the connection determination unit 5 to the Reset terminal of the driving circuit 9, and the driving signals Hout and Lout stop being outputted. The driving circuit 9 is configured to prohibit the output of driving signals when the stop signal is inputted.

Furthermore, as shown in FIG. 18(*d*), the connection determination unit 5 outputs the stop signal to the Reset terminal of the driving circuit 9 for a predetermined period of time (from time t0 to time t1) after power is supplied. Although not shown in this drawing, the connection determination unit 5 outputs the stop signal continuously after time t1 while the LED module 21 is not being connected. When the LED module 21 has been connected, the stop signal is removed at time t1, as shown in FIG. 18(*d*), and the output of the driving signals Hout and Lout is started, as described above.

As shown in FIG. 18(*g*), the voltage occurring at the characteristic setting unit 2 has a voltage value which is determined by the current value Iref supplied from the setting power source 3 to the resistor R6 and the resistance value Rset of the resistor R6 as described above during a period up to time t1. After time t1, the driving signals Hout and Lout starts being outputted and a predetermined output voltage is generated in the voltage conversion unit 8. Accordingly, the voltage occurring at the characteristic setting unit 2 has a voltage value equal to the output voltage of the voltage conversion unit 8 after time t1.

As shown in FIG. 18(*h*), the signal inputted to the characteristic determination unit 4 is similar to the voltage generated at the characteristic setting unit 2 during the period up to time t1. After time t1, a current is not supplied from the setting power source 3 to the resistor R6 because the voltage occurring at the characteristic setting unit 2 is higher than a voltage determined by the voltage division of the resistor R7 and the resistor R8. For this reason, the signal inputted to the characteristic determination unit 4 is equal to the voltage obtained by the voltage division of the resistors R7 and R8. Accordingly, after time t1, the information determination operation performed by the characteristic determination unit 4 is stopped in order to prevent the information of the LED module 21 from being erroneously determined.

In summary, immediately after the DC power DC is inputted as shown in FIG. 18(*a*), the supply of a control power voltage from the control power source 7 is started, as shown in FIG. 18(*b*). If the time at which the control power voltage reaches a predetermined level is to, the setting power source 3 starts to supply a control power at a constant current Iref from time t0 (FIG. 18(*c*)). Although the characteristic determination unit 4 and the connection determination unit 5 start their operations from time t0, the connection determination unit 5 has a timer and prevents a driving signal from being outputted from the driving circuit 9 by outputting the stop signal during the predetermined period up to time t1, as shown in FIG. 18(*d*), regardless of the connection of the LED module 21.

Meanwhile, the characteristic determination unit 4 determines information previously set in the characteristic setting unit 2 during the period from time t0 to time t1, and outputs the set signal corresponding to the set current value to the feedback operation circuit 10. When the LED module 21 has been connected at time t1, the stop signal is removed by the connection determination unit 5, and the driving signal Hout is outputted as shown in FIG. 18(*f*). Prior to the driving signal Hout, the driving signal Lout is outputted for a brief period of time, as shown in FIG. 18(*e*), so that the switching device Q5 is turned on and, therefore, the capacitor C5 is charged via the diode D2. By using this capacitor C5 as a power source, the Hout terminal is allowed to have an electric potential higher than that of the Hgnd terminal and driving the gate of the switching device Q4 is enabled.

The switching device Q5 is turned on just once at first, which is enough. After the ON and OFF operation of the switching device Q4 has been started, the electric potential of the source of the switching device Q4 decreases when the regenerative diode D4 is on, in which case the capacitor C5 is charged via the diode D2.

When the LED module 21 has not been connected at time t1, the state at time t0 is maintained by stopping the time counting performed by the timer of the connection determination unit 5 and is sustained until the LED module 21 is connected. Here, the characteristic determination unit 4 repeats the characteristic determination operation.

Here, the LED module and the lighting apparatus described in this embodiment are contained in the illumination device described in conjunction with the first embodiment (in FIG. 9). If an erroneous connection has occurred in the wiring which electrically connects between the lighting apparatus and the sockets during the assembly of the illumination device, in detail, if the connection terminals A1 and A2 or the connection terminals B1 and B2 have been erroneously wired, the information determination operation is performed by the characteristic determination unit 4 and the driving signal starts being outputted, as described above, because the characteristic setting unit 2 of this embodiment is formed only of the resistor R6 having no polarity.

In order to deal with the case where the wiring of the connection terminals A1 and A2 and the wiring of the connection terminals B1 and B2 have been erroneously connected, it is desirable to connect the same circuit to both the sockets 26 and 27 of the illumination device. That is, as shown in FIG. 15, the output terminals of the voltage conversion unit 8 are connected not only to the connection terminals A1 and A2 but also to the connection terminals B1 and B2. By doing so, the characteristic setting unit 2 and the light source unit 1 can operate even when they are connected to the connection terminals B1 and B2 of the lighting apparatus, with the result that there is no worry over a malfunction attributable to erroneous connection and therefore it is possible to use it without any changes.

Further, even when a user removes the LED module 21 from the illumination device and then reinstalls it in the illumination device, there is no malfunction attributable to an inverse connection and it can be used without any changes.

Additionally, when the connection determination unit 5 is configured to output the stop signal even when the input voltage is lower than, e.g., a predetermined voltage of V3 (see FIG. 17), the connection determination unit 5 outputs the stop signal even if a short circuit occurs between the connection terminals A1 and A2 or between the connection terminals B1 and B2 by any cause. Thus, the lighting apparatus maintains a stationary state and the lighting apparatus and the LED module can be safely used.

Here, although it has been described above that the characteristic determination unit 4 stops the characteristic determination operation after the driving signal starts being outputted, it is possible to stop the characteristic determination operation in response to the stop signal outputted from the connection determination unit 5, which is not shown in the drawings.

As described above, the lighting apparatus of the present embodiment has the same effect as those of the first to third embodiments, and can be used without causing a malfunction even though the LED module is mounted in a reverse direction due to the erroneous wiring of the illumination device or a user's fault.

Further, this embodiment is configured to detect the current supplied to the LED module and perform a feedback control, so that the current supplied to the LED module can be further stabilized, thereby preventing an excessive current from being supplied to the LED module. Furthermore, when the accidental breakdown of an electronic part or an abnormality of wiring, such as a short circuit or an opening, occurs, the lighting apparatus is stopped, thereby considerably improving reliability.

If the distance between the connection terminals A1 and A2 and the connection terminals B1 and B2 and the shapes of the terminals A1, A2, B1 and B2 are the same as those of the linear fluorescent lamp, the investment in the development of new sockets can be avoided because conventional sockets can be used as the sockets 26 and 27 of the illumination device without any changes.

On the contrary, if the distance between the terminals and the shapes of the terminals are designed to be different from those of the linear fluorescent lamp, on condition that one pin base is provided with two terminals, it is necessary to newly develop corresponding sockets, but a conventional body may be used as the body of the illumination device.

What is claimed is:

1. A lighting apparatus, comprising:

a light source module including a light source unit including a plurality of light-emitting diodes (LEDs) electrically connected to each other;

a characteristic setting unit for setting characteristic information on electrical characteristics of the LEDs;

a first pin base having a first electrode and a second electrode; and a second pin base having a third electrode and a fourth electrode;

wherein a direct current (DC) voltage supplied from a lighting apparatus is applied between the first electrode and the second electrode or between the third electrode and the fourth electrode, a constant voltage is supplied to an anode side of the LEDs of the light source unit, and the characteristic setting unit is connected between the first and second electrodes and/or between the third and fourth electrodes;

a voltage conversion unit, which includes at least one switching device, for receiving, as a power, an external DC voltage or a rectified voltage obtained by rectifying an input alternating current (AC) voltage, and for converting the received voltage into a desired voltage by turning on and off the corresponding switching device thereby to supply the desired voltage to the first pin base of the light source module;

a setting power source for supplying a power to the characteristic setting unit via the first or the second pin base; and a characteristic determination unit for determining the characteristic information, wherein the first and the second pin bases have a structure attachable to an illumination device for a fluorescent lamp, and the characteristic determination unit determines the characteristic information based on a signal generated at a pin base other than a pin base to which the voltage conversion unit is connected.

2. An illumination device, comprising:

the lighting apparatus of claim 1.

3. The lighting apparatus of claim 1, further comprising a rectifier connected between the first electrode and the second electrode and is formed of LEDs.

4. The lighting apparatus of claim 1, further comprising:

a connection determination unit configured to determine whether the light source module is connected to the lighting apparatus or not.

5. The lighting apparatus of claim 4, wherein the connection determination unit determines, when a voltage value occurring at the characteristic setting unit is higher than a predetermined value, that the light source module is disconnected, and outputs a stop signal to cut off a supply of power to the light source module.

6. The lighting apparatus of claim 4, wherein the characteristic determination unit determines the characteristic information after a predetermined period of time after the connection determination unit determines that the light source module is connected to the lighting apparatus.

7. The lighting apparatus of claim 1, wherein the characteristic determination unit measures a duration of a high state of a voltage generated from the characteristic setting unit, and outputs a signal representing a set current corresponding to the measured duration to the voltage conversion unit so that the voltage conversion unit adjusts its output current to be supplied to the light source module to be equal to the set current.

8. The lighting apparatus of claim 1, wherein the characteristic determination unit determines a set current depending on a value of a voltage generated from the characteristic setting unit, and outputs a signal representing the set current to the voltage conversion unit so that the voltage conversion unit adjusts its output current to be supplied to the light source module to be equal to the set current.

9. The lighting apparatus of claim 8, wherein the set current varies continuously or stepwisely depending on the value of the voltage generated from the characteristic setting unit.

10. The lighting apparatus of claim 1, wherein both of the light source unit and the characteristic setting unit are connected between the first and second electrode, and the voltage conversion unit is connected to not only between the first and second electrode but also between the third and fourth electrode to supply a power to the first and the second pin base of the light source module.

* * * * *